US008061177B2

(12) United States Patent
Jepson

(10) Patent No.: US 8,061,177 B2
(45) Date of Patent: Nov. 22, 2011

(54) REFRACTORY METAL POTS

(75) Inventor: Peter R. Jepson, Newbury, MA (US)

(73) Assignee: H.C. Starck Inc., Newton, MA (US)

( * ) Notice: Subject to any disclaimer, the term of this patent is extended or adjusted under 35 U.S.C. 154(b) by 421 days.

(21) Appl. No.: 10/593,620

(22) PCT Filed: Mar. 23, 2005

(86) PCT No.: PCT/US2005/009753

§ 371 (c)(1),
(2), (4) Date: Mar. 23, 2007

(87) PCT Pub. No.: WO2005/098073

PCT Pub. Date: Oct. 20, 2005

(65) Prior Publication Data

US 2007/0169529 A1 Jul. 26, 2007

(51) Int. Cl.
*B21D 22/00* (2006.01)

(52) U.S. Cl. ..... 72/356; 72/364; 72/377; 72/700

(58) Field of Classification Search ..... 72/201, 72/342.1, 356, 364, 700, 377, 206, 348; 148/407, 148/559, 668; 204/298.12, 298.13
See application file for complete search history.

(56) References Cited

U.S. PATENT DOCUMENTS

| | | | | |
|---|---|---|---|---|
| 4,939,829 | A * | 7/1990 | Maki et al. | 29/893.34 |
| 5,374,323 | A * | 12/1994 | Kuhlman et al. | 148/677 |
| 6,071,360 | A | 6/2000 | Gillespie | 148/421 |
| 6,142,001 | A * | 11/2000 | Collier | 72/97 |
| 6,193,821 | B1 | 2/2001 | Zhang | 148/668 |
| 6,210,502 | B1 * | 4/2001 | Takahashi | 148/670 |
| 6,250,128 | B1 * | 6/2001 | Ando et al. | 72/355.6 |
| 6,283,357 | B1 * | 9/2001 | Kulkarni et al. | 228/155 |
| 6,302,977 | B1 * | 10/2001 | Liu | 148/671 |

(Continued)

FOREIGN PATENT DOCUMENTS

JP 6-158297 * 6/1994

(Continued)

OTHER PUBLICATIONS

Thiebaut, C. (C.E.A. Centre De Valduc Service MM) et al: "Sheet forming of tantalum: comparison between experimental results and modelling." Plansee Ag. Reutte, Tyrol, Austria. May 1997. 971-983, Numerical Data, Photomicrographs, Graphs 12 Ref. Conference: 14$^{th}$ International Plansee Seminar '97. vol. 1: Metallic High Temperature Materials, Tirol, Austria, May 12-16, 1997, 1997, XP009050687.

*Primary Examiner* — Edward Tolan
(74) *Attorney, Agent, or Firm* — Connolly Bove Lodge & Hutz LLP

(57) ABSTRACT

Computer-implemented processes for making refractory metal pots, including: cutting an a refractory metal ingot into a first workpiece; subjecting the first workpiece to multiple upset forgings, annealings in a vacuum or inert gas to a temperature sufficiently high to cause at least partial recrystallization, forging-backs, and rollings to form a plate; wherein the forged, annealed workpiece undergoes a reduction in thickness after at least one rolling pass and is turned between at least one pass, to form the plate; and deep drawing the plate to form a pot; wherein dimensions of at least one workpiece or plate suitable for processing into a pot are pre-determined with a computer-implemented finite element modeling assessment method.

4 Claims, 6 Drawing Sheets

U.S. PATENT DOCUMENTS

| | | | | |
|---|---|---|---|---|
| 6,331,233 | B1 * | 12/2001 | Turner | 204/298.13 |
| 6,348,139 | B1 * | 2/2002 | Shah et al. | 204/298.13 |
| 6,419,806 | B1 * | 7/2002 | Holcomb et al. | 204/298.12 |
| 6,569,270 | B2 * | 5/2003 | Segal | 148/670 |
| 6,887,356 | B2 * | 5/2005 | Ford et al. | 204/298.12 |
| 7,014,722 | B1 * | 3/2006 | Arimoto et al. | 148/421 |
| 2002/0112789 | A1 * | 8/2002 | Jepson et al. | 148/422 |

FOREIGN PATENT DOCUMENTS

| | | | |
|---|---|---|---|
| JP | 8-232061 | * | 9/1996 |

* cited by examiner

REFRACTORY METAL POTS

FIELD OF THE INVENTION

The invention relates to plates, pots made from refractory metals or refractory metal alloys and to products which contain or are based on such pots.

BACKGROUND

Historically, the tooling for the fabrication of metal pots by deep drawing is developed by trial and error. Usually, it takes several iterations and experiments. For expensive materials such as refractory metals, e.g. tantalum, the cost of material consumed in such experiments can be prohibitively high. Also, ordinary methods produce pots having poor grain structure. Conventionally prepared metal pots are made of standard grade ingot-derived plates. These plates are known for their coarse and non-uniform grains, as well as for non-uniform crystallographic texture, particularly for tantalum and niobium. Unfortunately, these plates are unsuitable for use as components in sputtering targets.

For the foregoing reasons, it would be desired to develop better methods for making pots with properties suitable for use as sputtering targets, and being more cost-effective in both development and production.

DESCRIPTION OF THE FIGURES

These and other features, aspects, and advantages of the present invention will become better understood with reference to the following description and appended claims; where

SUMMARY OF THE INVENTION

Figure 1:
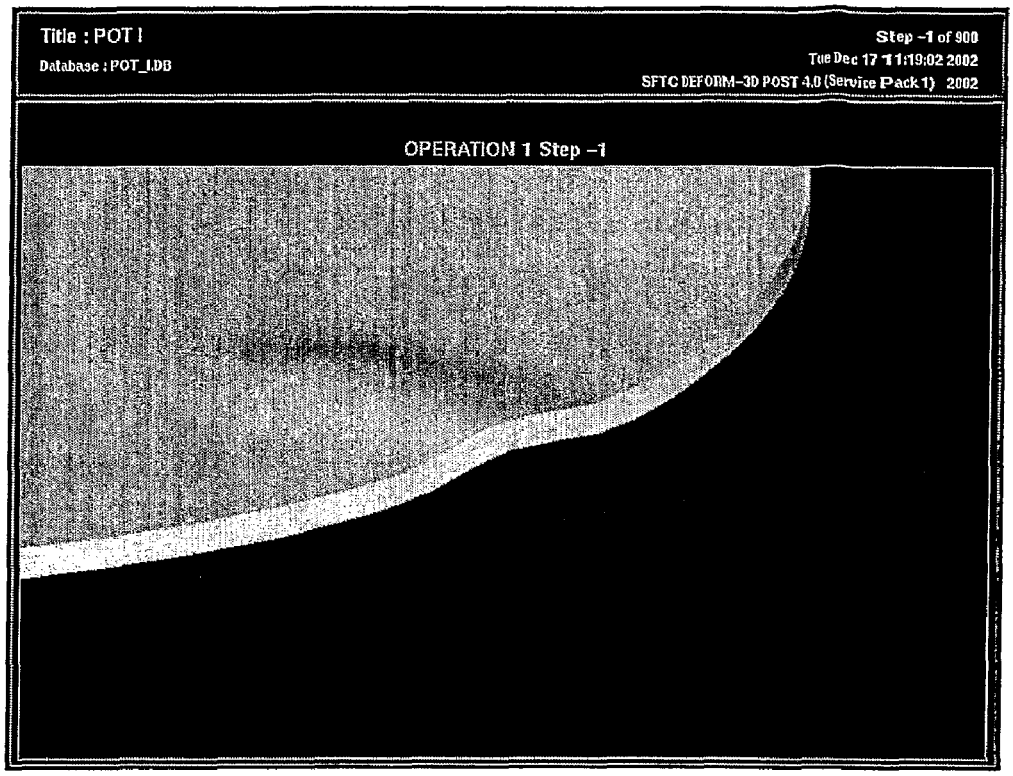
FIG. 1 shows a figure illustrating types and sizes of imperfection in the plate work piece that could lead to detrimental defects such as folds in the formed pot.
Figure 2:
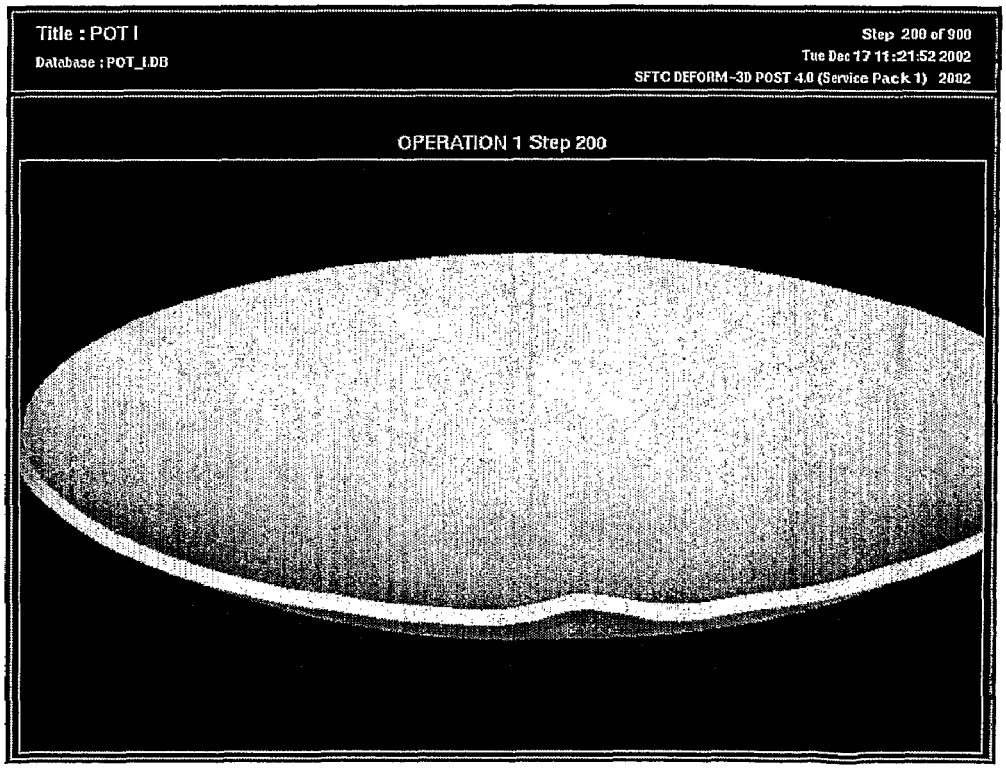
FIGS. 2-9 show a predicted sequence of events.
Figure 3:
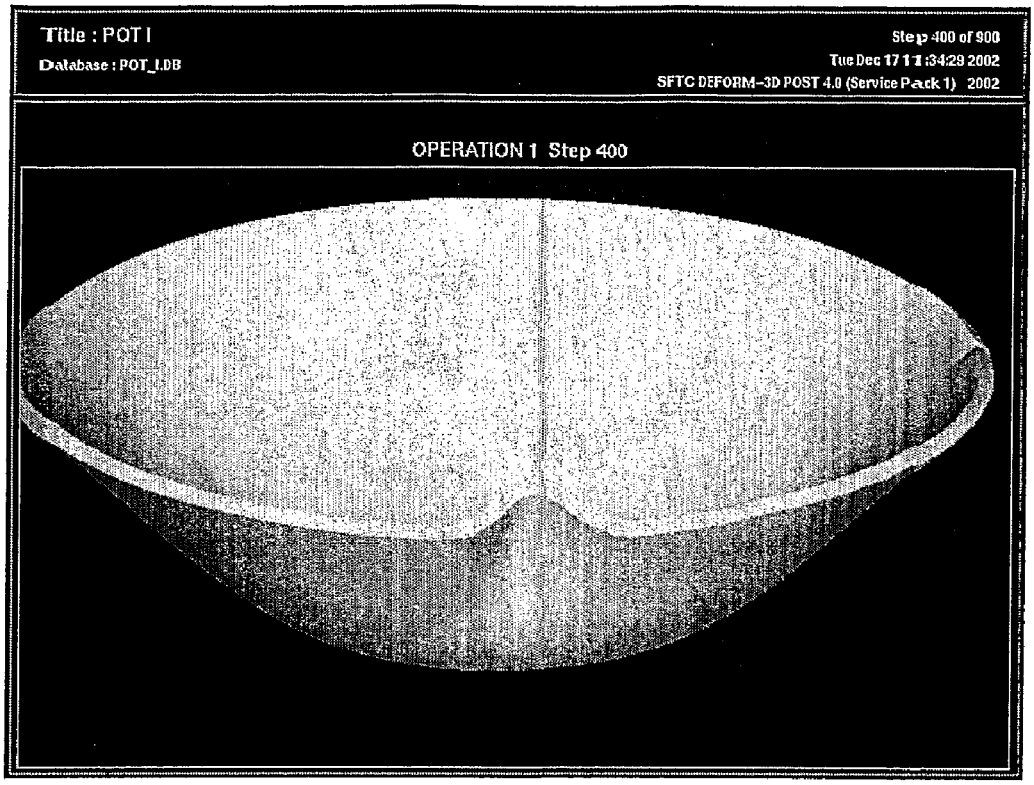
Figure 4:
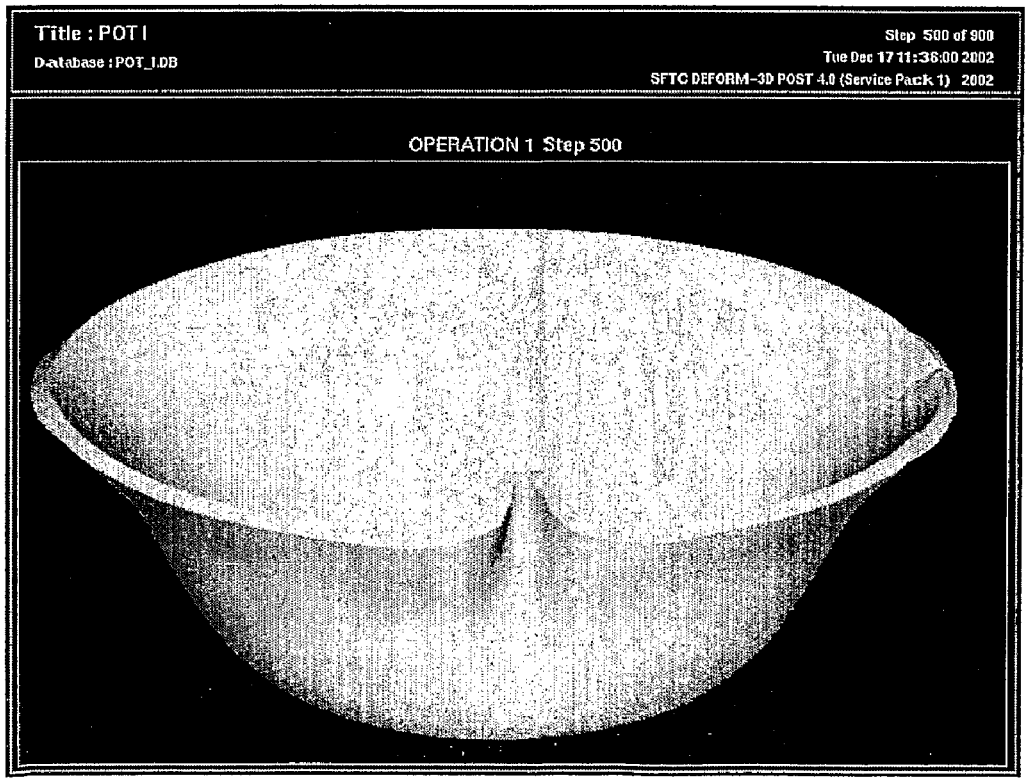
Figure 5:
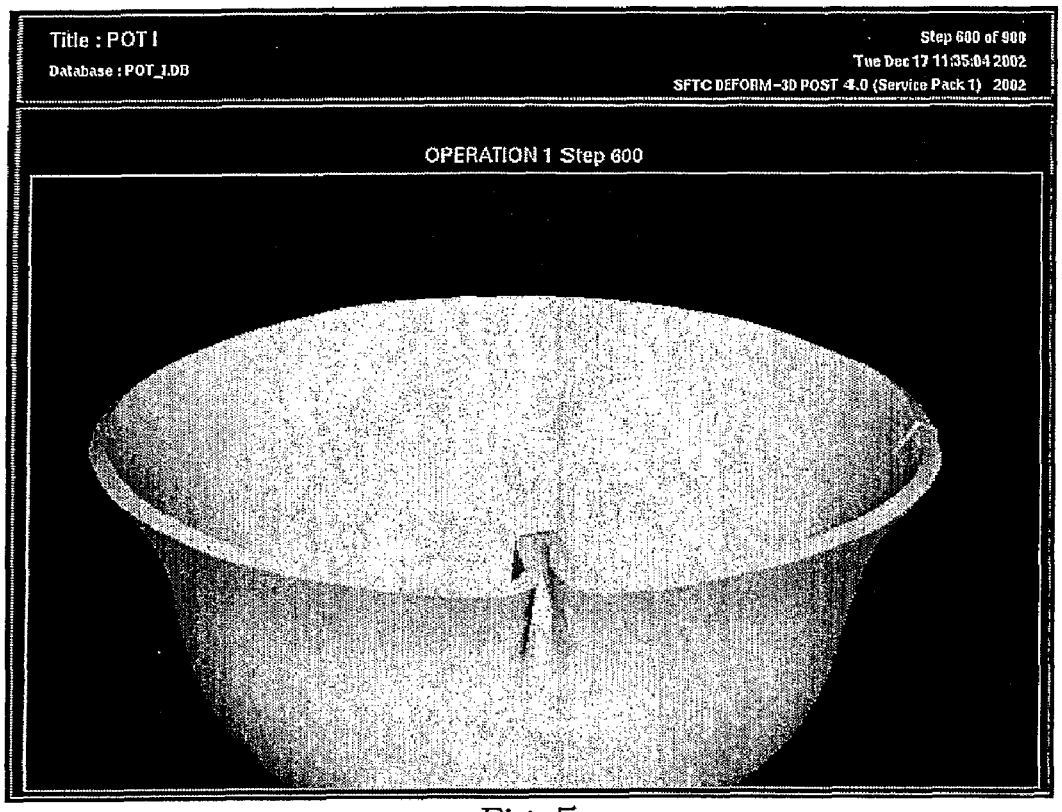
Figure 6:
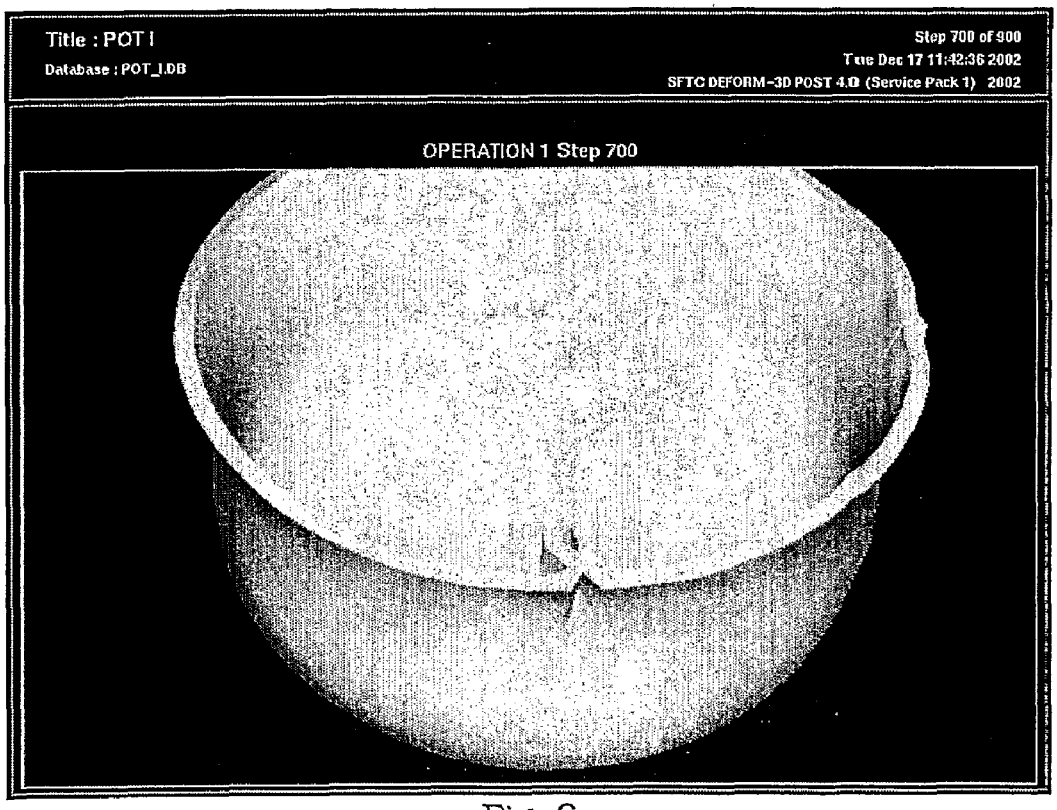
Figure 7:
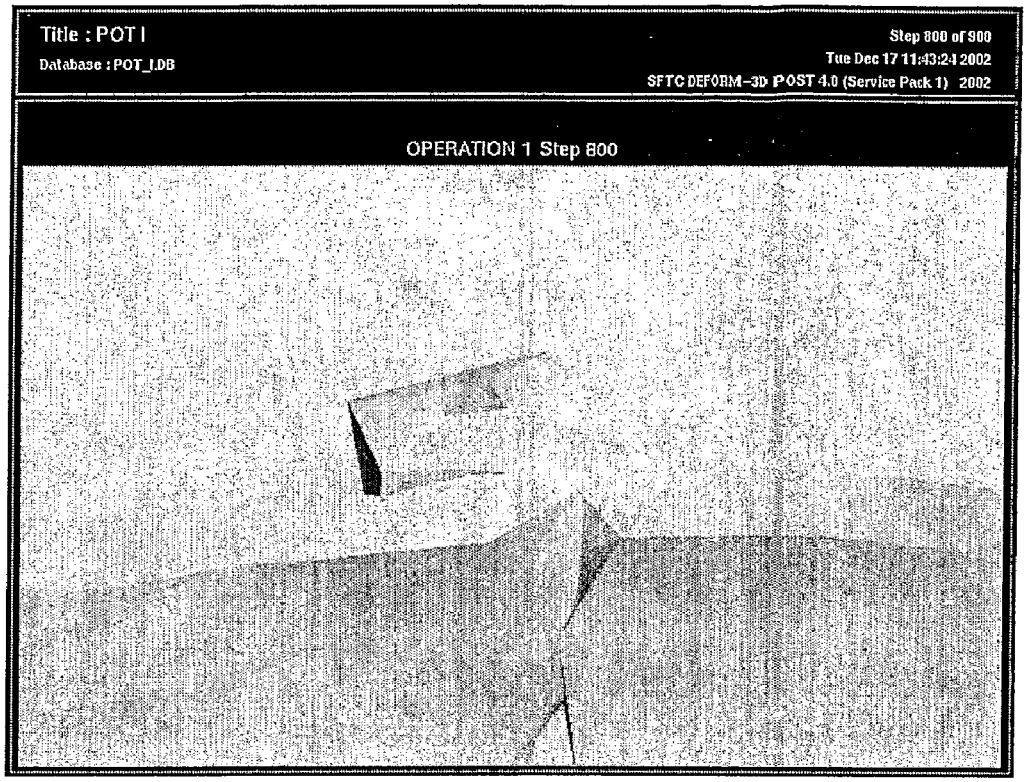
Figure 8:
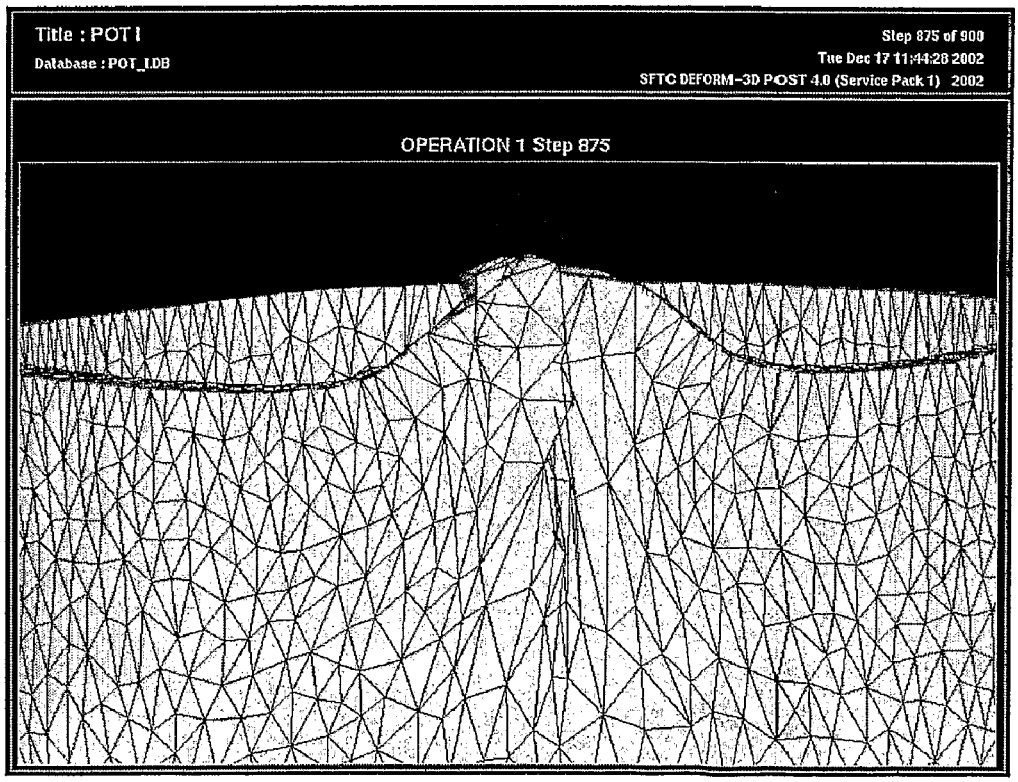
Figure 9:
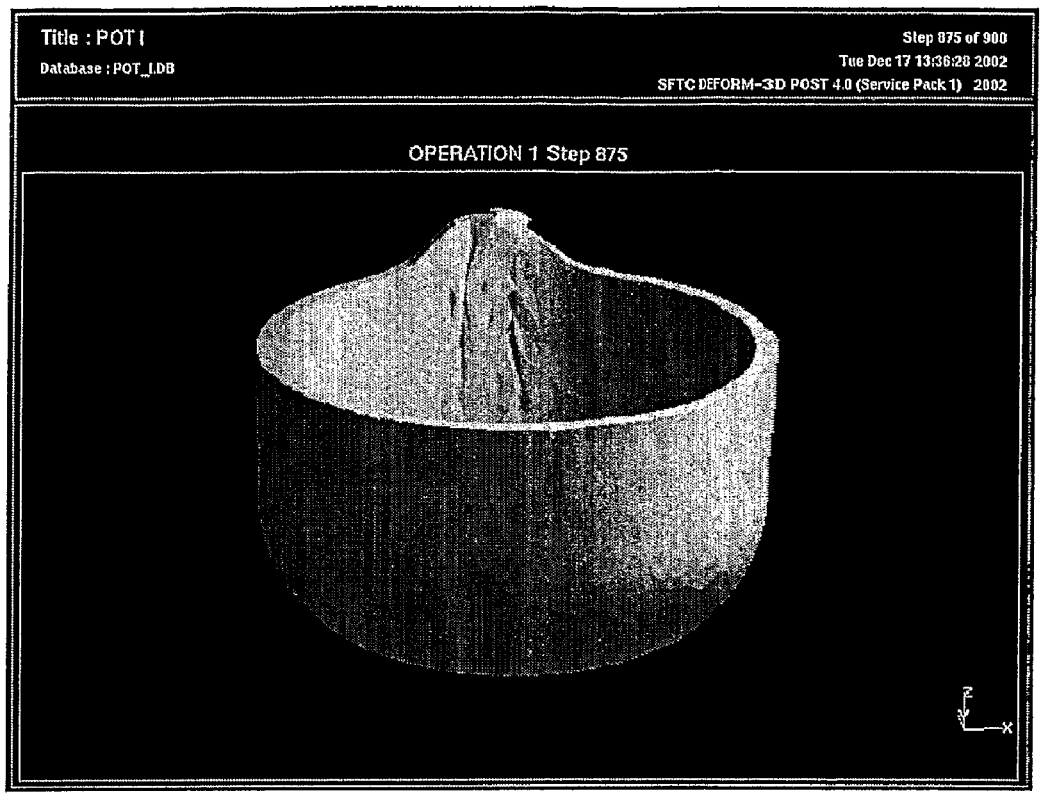

The invention relates to a process for making a pot comprising (a) cutting an ingot comprising a refractory metal component into a first work piece; (b) subjecting the first work piece to upset forging, and thereby forming a second work piece; (c) subjecting the second work piece to a first annealing step in a vacuum or an inert gas to a first temperature that is sufficiently high to cause at least partial recrystallization of the second work piece, and thereby forming an annealed second work piece; (d) forging-back the annealed second work piece by reducing the diameter of the second work piece, and thereby forming a third work piece; (e) subjecting the third work piece to upset forging, and thereby forming a fourth work piece; (f) forging back the fourth work piece by reducing the diameter of the fourth work piece, and thereby forming a fifth work piece; (g) subjecting the fifth work piece to a second annealing step to a temperature that is sufficiently high to at least partially recrystallize the fifth work piece; (h) subjecting the fifth work piece to upset forging, and thereby forming a sixth work piece; (i) subjecting the sixth work piece to a third annealing step, and thereby forming an annealed sixth work piece; (j) rolling the annealed sixth work piece into a plate by subjecting the annealed sixth work piece to a plurality of rolling passes; wherein the annealed sixth work piece undergoes a reduction in thickness after at least one pass and the annealed sixth work piece is turned between at least one pass, and thereby forming a plate; and (k) deep drawing the plate into a pot, thereby forming the pot; wherein a fourth annealing step is carried out either (1) after step (j) before step (k), or (2) after step (k), such that dimensions of at least one work piece or plate suitable for processing into a pot are pre-determined with a computer-implemented finite element modeling assessment method so that at least one work piece in steps (b)-(j) or plate in step (k) has dimensions that are substantially similar to the dimensions determined by the computer-implemented finite element modeling assessment method.

In one embodiment, the invention relates to a pot.

In another embodiment, the invention relates to a plate.

In another embodiment, the invention relates to a sputtering target comprising (a) a pot having a refractory metal component; and (b) a collar attached to the pot, in which the pot is made in accordance to the process described above.

In another embodiment, the invention relates to a method of developing the metal-forming process used to make the pot in an efficient and cost-effective way.

DESCRIPTION

Other than in operating examples or where otherwise indicated, all numbers or expressions referring to quantities of ingredients, reaction conditions, etc., used in the specification and claims are to be understood as modified in all instances by the term "about." Various numerical ranges are disclosed in this patent application. Because these ranges are continuous, they include every value between the minimum and maximum values. Unless expressly indicated otherwise, the various numerical ranges specified in this application are approximations.

The invention relates to a process for making a pot comprising (a) cutting an ingot comprising a refractory metal component into a first work piece; (b) subjecting the first work piece to upset forging, and thereby forming a second work piece; (c) subjecting the second work piece to a first annealing step in a vacuum or an inert gas to a first temperature that is sufficiently high to cause at least partial recrystallization of the second work piece, and thereby forming an annealed second work piece; (d) forging-back the annealed second work piece by reducing the diameter of the second work piece, and thereby forming a third work piece; (e) subjecting the third work piece to upset forging, and thereby forming a fourth work piece; (f) forging back the fourth work piece by reducing the diameter of the fourth work piece, and thereby forming a fifth work piece; (g) subjecting the fifth work piece to a second annealing step to a temperature that is sufficiently high to at least partially recrystallize the fifth work piece; (h) subjecting the fifth work piece to upset forging, and thereby forming a sixth work piece; (i) subjecting the sixth work piece to a third annealing step, and thereby forming an annealed sixth work piece; (j) rolling the annealed sixth work piece into a plate by subjecting the annealed sixth work piece to a plurality of rolling passes; wherein the annealed sixth work piece undergoes a reduction in thickness after at least one pass and the annealed sixth work piece is turned between at least one pass, and thereby forming a plate; and (k) deep drawing the plate into a pot, thereby forming the pot; wherein a fourth annealing step is carried out either (1) after step (j) before step (k), or (2) after step (k), such that dimensions of at least one work piece or plate suitable for processing into a pot are pre-determined with a computer-implemented finite element modeling assessment method so that at least one work piece in steps (b)-(j) or plate in step (k) has dimensions that are substantially similar to the dimensions determined by the computer-implemented finite element modeling assessment method.

The process involves cutting an ingot comprising a refractory metal component into a first work piece by any suitable method. For instance, the ingot can be cut by a band saw.

The shape and dimensions of the ingot can vary, depending on the application. In one embodiment, the ingot is cylindrical and it has a diameter ranging from 150 mm to 400 mm. The ingot is made from a refractory metal or a refractory metal alloy. The refractory metal component is generally selected from the group consisting of (a) niobium, (b) tantalum, (c) niobium alloys, (f) tantalum alloys, molybdenum, molybdenum alloys, tungsten, tungsten alloys, and combinations thereof.

The ingot can be of any purity suitable for the desired application. In one embodiment, the ingot can be made in accordance to the processes described in Clark et al. "Effect of Processing Variables on Texture and Texture Gradients in Tantalum" (Metallurgical Transactions A, September 1991), and Kumar et al., "Corrosion Resistant Properties of Tantalum", Paper 253 Corrosion 95, NAC International Annual Conference and Corrosion Show (1995), incorporated herein by reference in their entirety. In another embodiment, the ingot can be made in accordance to processes described in US Patent Application Publication 2002/0112789 or U.S. Ser. No. 09/906,208, incorporated herein by reference in its entirety. As such the purity of the ingot can vary. In one embodiment, the ingot is a tantalum ingot having a purity, not including interstitial impurities that is at least 99.95%, preferably at least 99.999%. A purity of 99.9999% can also be obtained. The purities do not include interstitial impurities.

The shape and dimensions of the first work piece can vary, depending on the application. In one embodiment, the first work piece has a diameter equal to that of the ingot, and a length-to-diameter ratio ranging from about 1.5:1 to about 3:1. The first work piece is subjected to upset forging and a second work piece forms. The shape and dimensions of the second work piece can vary, depending on the application. In one embodiment, the second work piece has a length ranging from about 50% of its original length to about 70% of its original length.

The second work piece is then subjected to a first annealing step in a vacuum or an inert gas to a first temperature that is at least about 1000° C., (or at least 1200° C. or 1300° C.), so that an at-least-partially recrystallized second work piece forms.

The annealed second work piece is forged back by reducing the diameter of the second work piece, and thereby forming a third work piece. This is done on a press forge using flat or shaped dies.

In one embodiment, the third work piece has a diameter ranging from about 60% of the diameter of the first work piece to about 120% of the diameter of the first work piece.

The shape and dimensions of the third work piece can vary, depending on the application. The third work piece is subjected to upset forging, and a fourth work piece forms.

The shape and dimensions of the fourth work piece can vary, depending on the application. In one embodiment, the fourth work piece has a length ranging from about 80% of the length of the second work piece to about 120% of the length of the second work piece.

The fourth work piece is forged back by reducing the diameter of the fourth work piece and a fifth work piece thereby forms. This is done on a press forge using flat or shaped dies. In one embodiment, the fifth work piece has a diameter ranging from about 60% of the diameter of the first work piece to about 120% of the diameter of the first work piece.

The fifth work piece is subjected to a second annealing step to a temperature that is sufficiently high to fully recrystallize the fifth work piece. In one embodiment, the second annealing step is carried out at a temperature ranging from about 1000° C. to about 1300° C., preferably about 1200° C.

The fully recrystallized fifth work piece is subjected to upset forging, and thereby a sixth work piece forms. Upsetting the billet (the fifth work piece), rather than laying it down and flat-forging, is preferred because (a) it keeps the work piece round, thus almost eliminating the wastage which would occur if the work piece was made rectangular and a disc was cut from it, and (b) the through-thickness texture gradient found in the plate is much weaker when the billet is upset rather than flat-forged.

In one embodiment, the upset forging step is carried out between flat dies with a press. In another embodiment, the upset forging step is carried out in a first stage and a second stage, such that the first stage is carried out with flat dies and the second stage is carried out with a plurality of blows, using sheetbar dies, so that the work piece is turned by a suitable angle, e.g., 90°, between blows. Sheetbar dies are dies which have a slight convex curvature to their working faces.

The sixth work piece is subjected to a third annealing step, and thereby an annealed sixth work piece forms. In one embodiment, the third annealing step is carried out at a temperature ranging from about 800° C. to about 1200° C. Preferably, the third annealing step is carried out at a temperature of about 1065° C., and preferably, full recrystallization is achieved. The length-to-diameter ratio of the sixth work piece can vary, depending on application. Generally, the length-to-diameter ratio is at most about 1:2. In one embodiment, the sixth work piece has a length-to-diameter ratio ranging from about 1:2 to about 1:5.

The annealed sixth work piece is subjected to rolling and made into a plate by subjecting the annealed sixth work piece to a plurality of rolling passes; such that the annealed sixth work piece undergoes a reduction in thickness after each pass and the annealed sixth work piece is turned, e.g., between every two passes, so that a plate is thereby formed. The sixth work piece is rolled to plate of suitable thickness. Each pass achieves a reduction in thickness great enough that the strain imparted during that pass is substantially uniform through the thickness. The reduction in thickness (measured as a percentage of the thickness before that pass) is substantially the same for each and every pass. In one embodiment, each pass preferably achieves a 15% reduction in thickness. In one embodiment, the work piece is turned 90° between passes, except half-way through the schedule it is (one time only) turned 45°. For the last few passes, the angle of turning, and the reduction in thickness, may be adjusted, depending on the exact dimensions of each work piece, as measured directly before those last few passes. The rolling schedule is preferably chosen so that (a) the plate ends up substantially circular, (b) the 'crowning' effect (wherein the plate is thicker in the middle than at the edge) is controlled so that the optimum ratio of thickness-in-the-centre to thickness-at-the-edge is achieved, and (c) the variation in thickness from point to point around the perimeter is minimized.

The dimensions of the plate can vary. In one embodiment, the plate has a diameter ranging from about 500 mm to about 1 m, and a thickness ranging from about 6 mm to about 15 mm.

The plate is preferably subjected to deep drawing so that a pot forms from the plate. The plate can be formed into the pot by any method which enables an artisan to form a pot in accordance to the invention.

In one embodiment, the plate is deep-drawn into the shape of a hollow cathode component used to make sputtering targets. This can be done by using a punch and die and a suitable forging press (500 tons load capability is adequate). Particular features of the forming include: a punch, the outside shape of which resembles closely the inside shape desired of the workpiece. Thus, the amount of material needing to be machined off the inside surface can be minimized.

A die which generally includes, as an upper part, a step in which the plate is located, and a middle part. The middle part can be a conical section having a suitable angle, e.g., a 45° conical section, with generous radii connecting it to the upper and lower parts, to allow the work piece to flow smoothly into the lower part, which is dimensioned so that throughout the height of the wall of the pot, the work piece is trapped between it and the punch, without any gap. Preferably, the change in thickness of the work piece during the forming is taken into consideration in the dimensioning of the lower part of the die.

A pre-form punch is preferably used. The pre-form punch is designed so that if any buckle is created during the early stages of the forming process, it is flattened out again, by pressing it against the 45° conical section. As such, the formation of a fold, which would be detrimental, can be avoided. Lubrication of the die, between the die and the work piece, is preferred. Otherwise the die may become damaged. Optionally, a further forming operation can be conducted on the work piece, in which the top part (for example the top 2") is upset to form a thicker rim, which can form a flange, or which can form a partial flange to which a ring can be welded to form a complete flange.

A fourth annealing step is carried out either (1) after step (j) before step (k), or (2) after step (k). In one embodiment, the fourth annealing step is carried out at a temperature ranging from about 800° C. to about 1200° C.

Advantageously, the pot has a uniform grain size (uniform grain structure) throughout its volume. The uniformity is such that the average grain size of any microscope field, when measured accurately per ASTM E112, will preferably be within 0.5 ASTM points of the average grain size. For example, if 4 microscope fields through the thickness of a sample cut from the edge of a plate are examined, they may be measured at ASTM 4.9, ASTM 4.7, ASTM 4.7 and ASTM 5.2. If 4 microscope fields through the thickness of a sample cut from the centre of the same plate are examined, they may be measured at ASTM 5.2, ASTM 4.3, ASTM 4.9 and ASTM 4.8. Thus all fields are within 0.5 of the average of ASTM 4.8. The grain size is measured on the plate because during the forming process, the grains are deformed, making their size difficult to measure after forming. If the final annealing were done after the forming operation, the grain size would be measured on the formed work piece. In one embodiment, the grain size ranges from about ASTM 4 to about ASTM 6, as defined in ASTM Standard E112.

Also, the pot made in accordance to the invention has various texture features. Preferably, the texture exhibits (a) an absence of banding i.e., no bands each of which has a significantly different texture from its neighbors, and (b) a mixed texture, in which grains with [100] parallel to the plate normal, and grains with [111] parallel to the plate normal, are the two strongest components. In one embodiment, the texture achieved is described, as percentage of area, as follows in Table 1:

TABLE 1

| 100 Within 15° of Plate Normal | 111 Within 15° of Plate Normal |
|---|---|
| 16% to 28% | 20% to 32% |

The dimensions of the pot can vary. In one embodiment, the pot has a height ranging from about 150 mm to about 500 mm and a diameter ranging from about 100 mm to about 500 mm.

The process subjects the work pieces to advantageous true strains. In one embodiment, the first work piece is subjected to a true strain that is from about 0.25 to about 0.5 before the first annealing step. In another embodiment, the work piece is subjected to a strain that is greater than about 1 and less than about 2 before being subjected to the second annealing step. In another embodiment, the second, third, and fourth work pieces in steps (d), (e), and (f), respectively, are subjected to a true strain that is greater than about 1 and less than about 2 before being subjected to the second annealing step. And in another embodiment, the plate or the pot is subjected to a strain that is greater than about 1 before being subjected to the fourth annealing step. Preferably, all of the foregoing steps in this paragraph are practiced. Subjecting work pieces to such true strains is advantageous, because it enables achievement of the desired grain structure and texture.

The process for making a pot (or plate) further comprises pre-determining dimensions of at least one work piece or plate suitable for processing into a pot with a computer-implemented finite element modeling assessment method. The use of finite element modeling assists in designing the die to achieve the trapping of the work piece described above. The use of finite element modeling can help develop process steps that avoid making finished pieces with unacceptable dimensions. The use of finite element modeling can also avoid wasting material and time. For instance, by analyzing the forming process using finite element modeling, the thickening of work pieces formed during the process can be accurately estimated, and the dies can then be redesigned to ensure that only those work pieces which produce the desired pots are used. Also, the use of finite element modeling can help define the types and sizes of imperfections in the plates or work pieces that can be used during the process which would lead to detrimental defects such as folds in the formed pot. Finite element modeling can be performed with a commercially available software, e.g., DEFORM 3D, SFTC, Columbus, Ohio.

Figure 10:
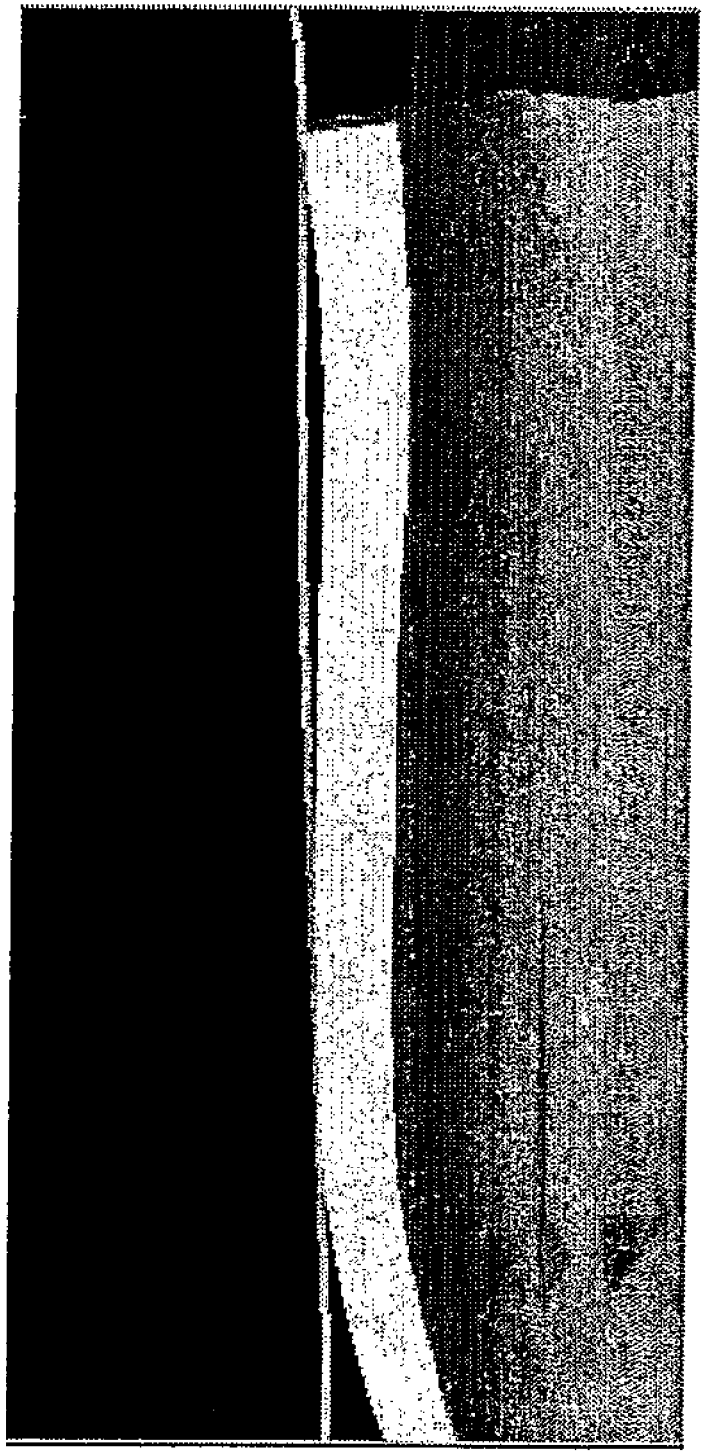
FIG. 10 is a computer generated image that shows what happens to the side-wall of a formed pot if the die has not been designed in accordance with the invention: the side-wall is not 'trapped' and its inside diameter is therefore not precisely controlled.

Referring to the figures, FIG. 1 shows a figure illustrating types and sizes of imperfection in the plate work piece that could lead to detrimental defects such as folds in the formed pot. FIGS. 2-9 show the predicted sequence of events. More particularly, deep-drawing of a plate with one side pushed out of flat, FIG. 1 (the deformation being 0.25" deep) was modelled. The predicted sequence of events is shown in FIGS. 2 through 9. To calculate the inches stroke of the punch, the step number is divided by 50. Advantageously, the use of finite element modeling assists in designing the die to achieve the trapping of the work piece. FIG. 10 is a computer generated image that shows what happens to the side-wall of a formed pot if the die has not been designed in accordance with the invention: the side-wall is not 'trapped' and its inside diameter is therefore not precisely controlled. By analyzing the forming process using Finite Element Modelling, the thickening of the work piece during forming can be accurately estimated, and the dies can then redesigned to trap the work piece and ensure that the whole of its inside surface presses tightly against the punch at the end of the forming stroke.

In one embodiment when finite element modeling is used, at least one work piece in steps (b)-(j) or plate in step (k) has dimensions that are substantially similar to the dimensions determined by the computer-implemented finite element modeling assessment method. Alternatively, in another embodiment, the process further comprises the steps of predetermining the types and sizes of imperfections of at least one work piece or plate unsuitable for processing into a pot with a computer-implemented finite element modeling assessment method, such that at least one work piece in steps (b)-(j) or plate in step (k) does not have at least one imperfection determined by the computer-implemented finite element modeling assessment method to lead to an unacceptable product.

The pots made in accordance to the invention can be useful in several applications. In one application, for instance, the pots can be used to make sputtering targets. Generally, the sputtering target is made by attaching a collar (a flange) to the lip of the pot. Such a sputtering target generally comprises: (a) a pot having a refractory metal component; and (b) a collar attached to the pot, such that the pot is made by a process comprising: (a) cutting an ingot comprising a refractory metal component into a first work piece; (b) subjecting the first work piece to upset forging conditions, and thereby forming a second work piece; (c) subjecting the second work piece to a first annealing step in a vacuum or an inert gas to a first temperature that is at least about 1200° C., and thereby forming an annealed second work piece; (d) forging-back the annealed second work piece by reducing a diameter of the second work piece, and thereby forming a third work piece; (e) subjecting the third work piece to upset forging conditions, and thereby forming a fourth work piece; (f) forging back the fourth work piece by reducing a diameter of the fourth work piece, and thereby forming a fifth work piece; (g) subjecting the fifth work piece to a second annealing step to a temperature that is sufficiently high to fully recrystallize the fifth work piece; (h) subjecting the fifth work piece to upset forging conditions, and thereby forming a sixth work piece; (i) subjecting the sixth work piece to a third annealing step, and thereby forming an annealed sixth work piece; (j) rolling the annealed sixth work piece into a plate by subjecting the annealed sixth work piece to a plurality of rolling passes; wherein the annealed sixth work piece undergoes a reduction in thickness after at least one pass and the annealed sixth work piece is turned, e.g., between every two passes, and thereby forming a plate; and (k) deep drawing the plate into a pot, thereby forming the pot; such that a fourth annealing step is carried out either (1) after step (j) before step (k), or (2) after step (k). The collar can be attached to the pot by any suitable technique. In one embodiment, the collar is welded to the pot.

The collar can be made from any suitable material. In one embodiment, the collar is made from a refractory metal component or a metal that can be welded to the pot material in such a way as to give a joint free from cracks. In one embodiment, the collar is made from a refractory metal component selected from the group consisting of (a) niobium, (b) tantalum, (c) niobium alloys, (f) tantalum alloys, and combinations thereof.

To make a sputtering target, the collar-containing pot is then subjected to finish machining, which generally includes but is not limited to CNC machining all over, and addition of fastening and sealing features to the collar.

In another embodiment, the pots made in accordance to the invention can be used to make crucibles. Uses of the pots also include applications requiring corrosion resistance to liquid materials at elevated temperatures, containers for containing acids in wet capacitors and the source of metal in physical vapor deposition by evaporation.

The invention includes the plate that is used to make the above-described pots as well as the processes used to make such a plate. As such, One embodiment of the invention encompasses a process for making a plate comprising: (a) cutting an ingot comprising a refractory metal component into a first work piece; (b) subjecting the first work piece to upset forging conditions, and thereby forming a second work piece; (c) subjecting the second work piece to a first annealing step in a vacuum or an inert gas to a first temperature that is at least about 1200° C., and thereby forming an annealed second work piece; (d) forging-back the annealed second work piece by reducing a diameter of the second work piece, and thereby forming a third work piece; (e) subjecting the third work piece to upset forging conditions, and thereby forming a fourth work piece; (f) forging back the fourth work piece by reducing a diameter of the fourth work piece, and thereby forming a fifth work piece; (g) subjecting the fifth work piece to a second annealing step to a temperature that is sufficiently high to fully recrystallize the fifth work piece; (h) subjecting the fifth work piece to upset forging conditions, and thereby forming a sixth work piece; (i) subjecting the sixth work piece to a third annealing step, and thereby forming an annealed sixth work piece; (j) rolling the annealed sixth work piece into a plate by subjecting the annealed sixth work piece to a plurality of rolling passes; wherein the annealed sixth work piece undergoes a reduction in thickness after at least one pass and the annealed sixth work piece is turned, e.g., between every two passes, (i) subjecting the plate to a fourth annealing step, and thereby forming the plate.

The fourth annealing step used to make the plate, as described above, can be carried out at a temperature ranging from about 950° C. to about 1200° C.

Also, the invention includes "planar" sputtering targets including a plate made in accordance to the process described in the paragraph above and a backing plate that is attached to the plate. To make a sputtering target, the plate and the backing plate is then subjected to finish machining, which includes but is not limited to CNC machining of fastening and sealing features.

The invention provides previously unavailable advantages. For instance, the invention reduces the cost and time to develop the tooling for forming of metals by the use of computer modeling and less expensive metals. The invention also enables the artisan to produce pots with uniform texture and grain structure by starting with plates of similar properties. This means that the invention enables artisans to achieve lower developmental costs, shorter developmental cycles, pots having more uniform grain-size, pots having more uniform crystallographic texture. Also, it is possible to develop pots having desired grain size and desired texture.

Although the present invention has been described in detail with reference to certain preferred versions thereof, other variations are possible. Therefore, the spirit and scope of the appended claims should not be limited to the description of the versions contained therein.

What is claimed is:

1. A sputtering target comprising:

(a) a pot having a refractory metal component; and (b) a collar attached to the pot; wherein the pot is made by a process comprising:

(a) cutting an ingot comprising a refractory metal component into a cylindrical first work piece;

(b) subjecting the first work piece to upset forging, and thereby forming a second work piece;

(c) subjecting the second work piece to a first annealing step in a vacuum or an inert gas to a first temperature that is sufficiently high to cause at least partial recrystallization of the second work piece, and thereby forming an annealed second work piece;

(d) forging-back the annealed second work piece by reducing the diameter of the second work piece, and thereby forming a third work piece;

(e) subjecting the third work piece to upset forging, and thereby forming a fourth work piece;

(f) forging back the fourth work piece by reducing the diameter of the fourth work piece, and thereby forming a fifth work piece;

(g) subjecting the fifth work piece to a second annealing step to a temperature that is sufficiently high to at least partially recrystallize the fifth work piece;

(h) subjecting the fifth work piece to upset forging, and thereby forming a sixth work piece;

(i) subjecting the sixth work piece to a third annealing step, and thereby forming an annealed sixth work piece;

(j) rolling the annealed sixth work piece into a plate by subjecting the annealed sixth work piece to a plurality of rolling passes; wherein the annealed sixth work piece undergoes a reduction in thickness after at least one pass and the annealed sixth work piece is turned between at least one pass, and thereby forming a plate; and (k) deep drawing the plate into a pot, thereby forming the pot;

wherein a fourth annealing step is carried out either (1) after step (j) before step (k), or (2) after step (k), wherein the upset forging and forging back of the work pieces is carried out such that the diameter of the work piece in each instance is increased or reduced, respectively by upset forging and forging back, relative to a longitudinal axis of the cylindrical first work piece, and wherein dimensions of at least one work piece or plate suitable for processing into a pot are pre-determined with a computer-implemented finite element modeling assessment method so that at least one work piece in steps (b)-(j) or plate in step (k) has dimensions that are substantially similar to the dimensions determined by the computer-implemented finite element modeling assessment method.

2. The sputtering target of claim 1, wherein the collar is welded to the pot.

3. The sputtering target of claim 1, wherein the collar is made from a refractory metal component or a metal that can be welded to the pot material in such a way as to give a joint free from cracks.

4. The sputtering target of claim 1, wherein the collar is made from a refractory metal component is selected from the group consisting of (a) niobium, (b) tantalum, (c) niobium alloys, (f) tantalum alloys, and combinations thereof.

* * * * *